US010222018B2

(12) United States Patent
Boinet

(10) Patent No.: US 10,222,018 B2
(45) Date of Patent: Mar. 5, 2019

(54) LIGHT MODULE AND HEADLIGHT PROVIDED WITH SUCH A MODULE

(71) Applicant: Valeo Vision, Bobigny (FR)

(72) Inventor: Loic Boinet, Le Mesnil Esnard (FR)

(73) Assignee: VALEO VISION, Bobigny (FR)

( * ) Notice: Subject to any disclaimer, the term of this patent is extended or adjusted under 35 U.S.C. 154(b) by 517 days.

(21) Appl. No.: 14/963,544

(22) Filed: Dec. 9, 2015

(65) Prior Publication Data

US 2016/0195232 A1 Jul. 7, 2016

(30) Foreign Application Priority Data

Dec. 10, 2014 (FR) ..... 14 62203

(51) Int. Cl.

| | |
|---|---|
| ***F21S 41/14*** | (2018.01) |
| ***F21S 41/16*** | (2018.01) |
| ***F21S 41/19*** | (2018.01) |
| ***F21S 41/20*** | (2018.01) |
| ***F21S 41/25*** | (2018.01) |
| ***F21S 41/143*** | (2018.01) |
| ***F21S 41/663*** | (2018.01) |
| ***F21S 41/675*** | (2018.01) |

(52) U.S. Cl.

CPC ..... *F21S 41/16* (2018.01); *F21S 41/14* (2018.01); *F21S 41/143* (2018.01); *F21S 41/19* (2018.01); *F21S 41/25* (2018.01); *F21S 41/285* (2018.01); *F21S 41/663* (2018.01); *F21S 41/675* (2018.01)

(58) Field of Classification Search

CPC ..... F21S 41/16; F21S 41/675; F21S 41/67; F21S 41/25; F21S 41/19

See application file for complete search history.

(56) References Cited

U.S. PATENT DOCUMENTS

| | | | | |
|---|---|---|---|---|
| 8,956,025 | B2 | 2/2015 | Kushimoto | |
| 9,377,169 | B2 * | 6/2016 | Suckling | F21S 41/16 |
| 9,383,070 | B2 * | 7/2016 | Khrushchev | F21K 9/56 |
| 2011/0249460 | A1 | 10/2011 | Kushimoto | |
| 2014/0029282 | A1 | 1/2014 | Ravier et al. | |
| 2015/0124466 | A1 | 5/2015 | Kushimoto | |

(Continued)

FOREIGN PATENT DOCUMENTS

| | | | |
|---|---|---|---|
| DE | 102012100141 | A1 | 7/2013 |
| DE | 102013200925 | A1 | 7/2014 |

(Continued)

*Primary Examiner* — William N Harris

(74) *Attorney, Agent, or Firm* — Oblon, McClelland, Maier & Neustadt, L.L.P.

(57) ABSTRACT

A light module for a motor vehicle headlight comprising first and second light radiation sources suitable for emitting light radiations to a wavelength conversion device which is likely to re-emit a light radiation to an optical projection system to produce a light beam, wherein the module comprises a single wavelength conversion device which is common to the radiations of the first and second sources, and the first light radiation source comprises at least one first light source suitable for emitting a first light beam which cooperates with a first scanning system, the first scanning system being provided with a means for deflecting the light rays emitted by the first light source and configured to scan the conversion device with the first light beam in a first direction.

20 Claims, 3 Drawing Sheets

(56) References Cited

U.S. PATENT DOCUMENTS

| | | | | |
|---|---|---|---|---|
| 2015/0316223 | A1* | 11/2015 | Ziegler ..... | F21S 41/14<br>362/510 |
| 2015/0369437 | A1 | 12/2015 | Reinprecht et al. | |

FOREIGN PATENT DOCUMENTS

| | | | |
|---|---|---|---|
| EP | 2690352 | A1 | 1/2014 |
| WO | 2014121315 | A1 | 8/2014 |
| WO | 2015036425 | A1 | 3/2015 |

* cited by examiner

LIGHT MODULE AND HEADLIGHT PROVIDED WITH SUCH A MODULE

CROSS-REFERENCE TO RELATED APPLICATIONS

This application claims priority to the French application 1462203 filed Dec. 10, 2014, which application is incorporated herein by reference and made a part hereof.

BACKGROUND OF THE INVENTION

1. Field of the Invention

The present invention relates to a light module intended to be arranged in a headlight of a vehicle, notably of a motor vehicle, and a headlight comprising such a light module.

2. Description of the Related Art

Traditionally, motor vehicles are equipped at the front with headlights suitable for forming light beams which are likely to fulfill different lighting functions taking into account traffic conditions, such as, for example, low beam, sidelight, high beam or even fog light functions.

Headlights are known from the prior art which are suitable for forming sophisticated light beams, also called adaptive, the dimensions, the intensity and/or the direction of which are adjusted to fulfill such functions. These headlights make it possible notably to produce directional, adaptive or glare-free high-beam light functions, comprising at least one zone for masking the beam in the zones where vehicles being overtaken or followed are situated.

Each headlight generally consists of a plurality of light modules that make it possible to obtain a light power that is sufficient to form a light beam. Each of these light modules then forms a part of the light beam of the headlight by being on or off separately relative to one another.

A "light module" should be understood to mean an assembly comprising at least one light source and one optical projection or reflection system.

When the light source is, for example, a laser source, the module can comprise a wavelength conversion device.

This laser light source of the light module is capable of emitting radiation toward a scanning system such as a micro-mirror movably mounted around two orthogonal axes. This radiation is then deflected by this scanning system to at least one wavelength conversion device which comprises a substrate made of reflective or transparent material on which is deposited a thin layer of phosphorescent material.

It will be noted in the present text that "photoluminescent material" should be understood to mean a material having a photo-luminescent effect, for example phosphorescent, generally comprising different chemical elements, but not necessarily containing phosphorus.

The conversion device, by thus being scanned by the scanning system, re-emits a white light radiation to an optical projection system and thus forms a part of the light beam of the headlight.

The modules of such a headlight are driven by a control unit which controls the activation of the laser light sources and the scanning systems to produce the different lighting functions of the headlight.

However, such a headlight, by thus comprising a plurality of light modules, is of significant bulk. Furthermore, it is costly and complex to design notably because it requires significant adjustment time and accurate parameterization of these light modules for the configuration of the different lighting functions.

What is more, such a headlight generally produces a light beam which can present different colors because each part of this beam is produced by each of these light modules and notably because of the variability of the layers of phosphorescent material from one module to another.

Furthermore, each light module with which this headlight is equipped is relatively ineffective compared to the nominal power of the laser sources: in effect, the rate of use of the power of the laser is low because, while it is being used, the laser is frequently underpowered to form a usual regulatory beam and avoid generating light spots in the beam which would not comply with the regulatory maxima. This is also necessary to avoid a visual nuisance for the driver, linked to an excessively strong lighting in proximity to the vehicle.

SUMMARY OF THE INVENTION

The object of the present invention is to wholly or partly remedy the various drawbacks cited above.

To this end, the subject of the invention is a light module for a motor vehicle headlight comprising first and second light radiation sources suitable for emitting light radiations to a wavelength conversion device which is likely to re-emit a light radiation to an optical projection system to produce a light beam, characterized in that the module comprises a single wavelength conversion device which is common to the radiations of the first and second sources, and the first light radiation source comprises at least one first light source suitable for emitting a first light beam which cooperates with a first scanning system, the first scanning system being provided with a means for deflecting the light rays emitted by the first light source and configured to scan the conversion device with the first light beam in a first direction.

Advantageously, the first scanning system is configured to scan the conversion device with the first light beam in a single unique first direction.

It will be understood that the light module, and consequently the headlight which includes it, are inexpensive to design and of small bulk. In effect, this light module makes it possible to produce all the lighting functions taking into account the traffic conditions and the relevant regulations, by comprising only a single wavelength conversion device and a single optical projection system. Thus, and advantageously, the beam generated is uniform in color and an accurate superpositioning of the different beam parts is produced without requiring mechanical adjustment between modules of a same headlight, since there is now only a single module.

Furthermore, it is possible to use different kinds of second laser radiation source, whether static, quasi-static or with scanning, without having to reconfigure the device for each kind.

According to different embodiments of the invention, which will be able to be taken together or separately:

- the first scanning system is provided with a mobile micro-mirror configured to scan the conversion device with the first light beam in the first direction,
- the first light source is a laser source, that is to say a source suitable for emitting a laser radiation like a laser diode,
- the second light radiation source is static or quasi-static, comprising at least one second light source configured to emit a second light beam directly onto a beam-forming member, for example a reflector,
- the second light radiation source comprises at least one second light source which cooperates with a second scanning system in a single direction,
- the second light radiation source is a laser source, the second light radiation source comprises a number of laser sources, the second light radiation source comprises optical elements to combine the laser rays from the different laser sources, the optical combination elements are based on a mixing of the polarizations of the laser rays and/or a mixing of different wavelengths and/or a juxtaposition of the images of the laser sources, the second light radiation source comprises at least one second light source which cooperates with a second scanning system in two directions, the second scanning system is provided with one or two mobile micromirrors configured to scan the conversion device with the second light beam in a first direction and/or a second direction substantially at right angles to the first direction, the first and second radiation sources are arranged on either side of the conversion device, the module comprises a support provided with a central wall bearing the conversion device, and two lateral walls, one bearing the first radiation source and the other the second radiation source, the conversion device is arranged in the axis of the optical projection system, the conversion device comprises a layer of phosphorescent material suitable for re-emitting a white light radiation, the conversion device is arranged in the light module so as to be able to receive radiations from the first light radiation source and from the second light radiation source, the conversion device is situated in the vicinity of the focal plane of the optical projection system, the first and second light radiation sources share the same conversion device and the same optical projection system, the light module comprises a control unit which is suitable for driving the first and second light radiation sources as a function of the desired photometry of the lighting beam produced by this light module, the control unit is suitable for defining zones of the layer that are suitable for scanning with the laser radiations so as to form an image on this layer, the image consists of a succession of lines each formed by a succession of more or less luminous dots, the first light radiation source is suitable for emitting a light radiation onto a first zone of the conversion device, and the second light radiation source is suitable for emitting a light radiation onto a second zone of the conversion device, the first zone and the second zone overlapping only over a strip, notably central, of the conversion device, the width of the strip is less than the width of the conversion device, notably less than 5% of the width of the conversion device. Optionally, the first zone and the second zone extend together over all of the conversion device. If appropriate, the light radiation sources each comprise a scanning system in a single direction, these directions being parallel, as a variant, the first light radiation source can comprise a scanning system in a single direction and the second light radiation source can comprise a scanning system in two directions. In this case, the first zone is an upper zone of the conversion device and the second zone is a lower zone of the conversion device, the first and second light radiation sources are each suitable for emitting a light radiation onto a same zone of the conversion device, notably onto all of the surface of the conversion device. If appropriate, the light radiation sources each comprise a scanning system in a single direction, these directions being at right angles to one another, the light module is suitable for emitting a light beam, for example high-beam lighting, corresponding to the superpositioning of the light beams resulting from the first and second light radiation sources cooperating with the wavelength conversion device and the optical projection system, the superpositioning can be partial or complete or even relate to only a fraction of the respective contours of these beams, the light beam can result from the superpositioning of at least two different light beams.

Another subject of the invention is a headlight for a motor vehicle comprising a light module according to the invention.

These and other objects and advantages of the invention will be apparent from the following description, the accompanying drawings and the appended claims.

BRIEF DESCRIPTION OF THE ACCOMPANYING DRAWINGS

Other advantages and features of the invention will become more apparent on reading the following description of a preferred embodiment, with reference to the figures, given as an indicative and nonlimiting example:

DETAILED DESCRIPTION OF THE PREFERRED EMBODIMENTS

Figure 1:
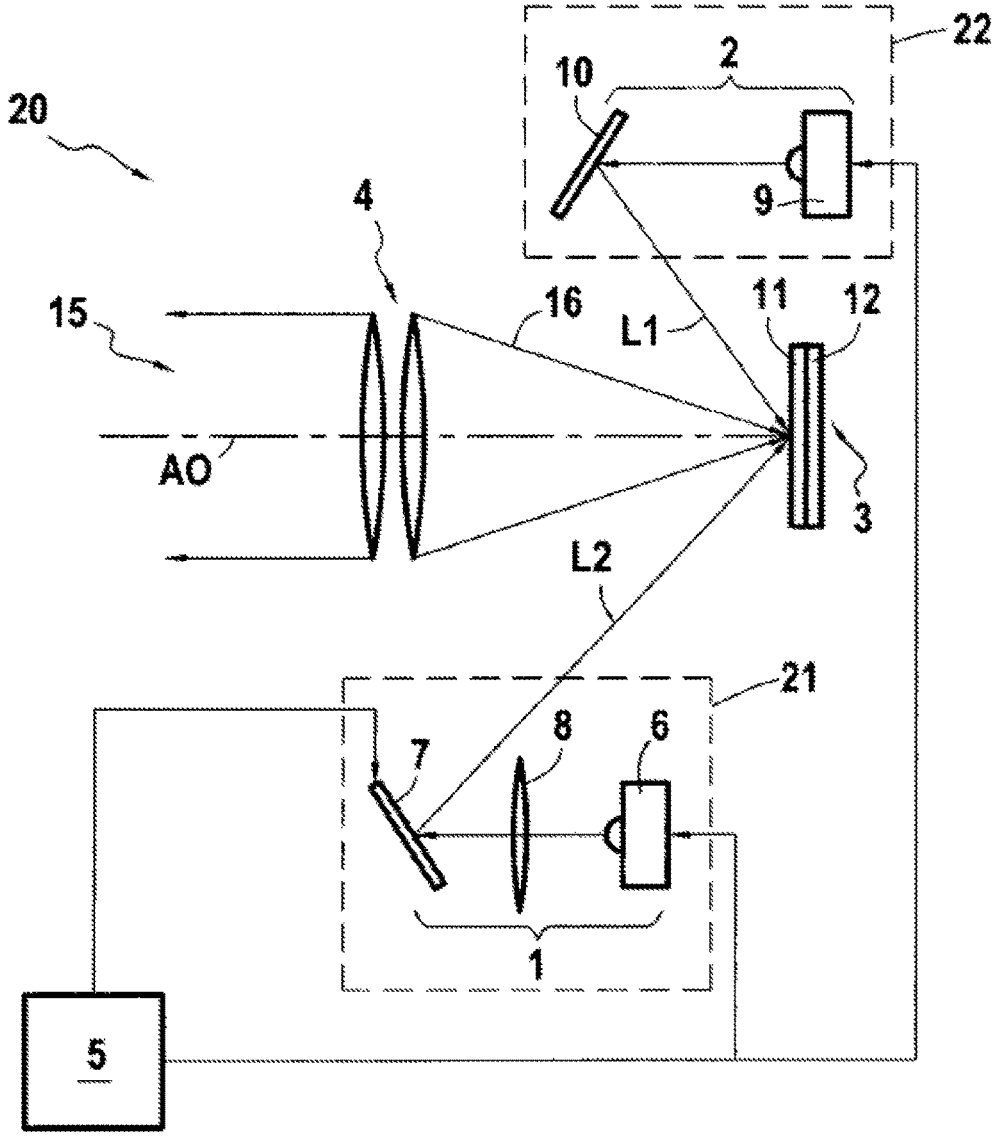
FIG. 1 is a schematic view of the light module according to a first embodiment of the invention.

Referring to FIG. 1, the light module according to this embodiment of the invention comprises first and second light radiation sources 1, 2. The first light radiation source 1 is arranged in a first unit 21 and the second light radiation source 2 is arranged in a second unit 22.

These first and second light radiation sources 1, 2 are suitable for emitting radiations L1, L2 to a common wavelength conversion device 3, which is likely to then transmit these beams to an optical projection system 4.

In all the embodiments of the invention, this first light radiation source 1 comprises: a first laser light source 6, a scanning system 7 provided with a deflection means and optical focusing elements 8. These optical focusing elements 8 are located between the first laser light source 6 and the scanning system 7. By virtue of the scanning system 7, the image from the conversion device 3 is made dynamic and makes it possible to produce adaptive light beams.

According to the variant embodiment represented, the second light radiation source 2 comprises a second laser light source 9 and a beam-forming member, for example a reflector 10. According to this preferred variant with a single laser light source 9, it does not comprise optical focusing elements or other elements between the laser source 9 and the reflector 10; the second laser light source 9 cooperates directly with the reflector 10. In a variant with a plurality of laser sources, not represented, it will be possible to provide optical elements to combine the laser rays from the different laser sources. These optical combining elements can, for example, be based on a mixing of the polarizations of the laser rays and/or a mixing of different wavelengths and/or a juxtapositioning of the images of the laser sources.

The scanning system 7, the reflector 10 and the optical projection system 4 are situated on the same side of the conversion device 3, that is to say that the conversion device 3 is used in reflection mode. The first laser light source 6 and the second laser light source 9 are quasi-spot light sources which consist of a laser diode emitting a visible beam with a wavelength of between 400 nanometers and 500 nanometers, preferably close to 450 or 460 nanometers. These wavelengths correspond to colors ranging from the blue to the near-ultraviolet, the latter color being more situated toward the wavelengths below 400 nanometers.

This laser diode can be provided with a single cavity and have a power lying between approximately 1 and 3.5 watts, preferably 1.6 watts or even 3 watts. This laser diode comprises an output facet whose dimensions can be of the order of 14 μm by 1 μm. It is preferably suitable for emitting a beam of elliptical section whose vertical and horizontal light intensity distribution profiles are Gaussian.

Advantageously, the second light radiation source 2 is arranged substantially above the optical axis AO (in dotted lines) of the optical projection system 4, with:

- the second laser light source 9 which can be positioned above and/or set back from the wavelength conversion device 3, and
- the reflector 10 which is positioned in front of the second laser light source 9, above the optical axis of the optical projection system 4 between the conversion device 3 and the optical projection system 4.

For example, the first light radiation source 1 is used to form the bottom part, projected onto the road, of the light beam generated by the module.

In the first embodiment of FIG. 1, the second light radiation source 2 is static because it makes it possible to statically form an image on the wavelength conversion device 3. However, this second light radiation source 2 will be able to be quasi-static because it can be displaced notably by a small angular amplitude and above all at low speed, notably to provide a range correction which corresponds to small, slow and global vertical movements to compensate for the loading of the vehicle or its dynamic response to braking and to acceleration. In the case where the second light radiation source 2 is static, with a fixedly mounted reflector 10, it will be possible to perform, in a conventional manner, a range correction with mechanical means situated outside the module and acting on the inclination of the module assembly.

The reflector 10 is a static mirror, fixedly mounted, or quasi-static, mounted to rotate about a horizontal axis in order to perform the requisite vertical range correction movements. "Quasi-static" should be understood in the present application to mean that it is driven by a movement of low amplitude and at low speed, less than 15°.s−1, preferably less than 10°.s−1, advantageously less than 4°.s−1. Compared to the scanning system 7 associated with the first laser light source 6, which comprises at least one micro-mirror that is mobile about a horizontal axis, the rate of oscillation about the horizontal axis of the reflector 10 is at least ten times smaller, preferably twenty times smaller, preferentially at least fifty times smaller. A standard scanning system 7 has, for example, a rate of oscillation of 150°.s−1. The scanning frequency should be at least greater than 20 Hz, and notably greater than 300 Hz.

The reflector 10 can be made of metal, for example of an aluminum-based alloy or even be made of glass aluminized on at least one face. It is of small size and can have the following dimensions: a height of approximately 1.5 to 6 mm, and a width of approximately 5.5 to 20 mm. This reflector 10 can be fixedly mounted relative to the second laser light source 9. In an execution variant, the reflector is quasi-static, that is to say that it can also be mounted mobile about an axis and driven, for example, by a servomotor or piezoelectric shims to produce the range correction movements, as mentioned above. This reflector 10 reflects a laser radiation L2 from this second laser light source 9 to the wavelength conversion device 3.

The scanning system 7 in a single direction of the first light radiation source 1 comprises, according to a preferred variant, a micro-mirror that can be square and each side of which can measure approximately 0.8 mm. This micro-mirror is made mobile about a single axis from, for example, an MEMS (Micro-Electro-Mechanical System) device.

In a variant, the first laser light source 6 and the scanning system 7 can be included in an MOEMS (Micro-Opto-Electro-Mechanical System). An MOEMS is an optical system comprising, in the present case, at least one laser light source and a scanning system 7. The MOEMS are devices that are compact, reliable and simple to use and which allow for great accuracy and great flexibility in redirecting the laser radiation L1 to the conversion device 3.

The wavelength conversion device 3 included in the light module comprises a substrate forming a reflecting support 12 which is covered by a continuous layer 11 of a phosphorescent material.

This support 12 of the conversion device 3 is chosen from materials which are thermally good conductors. Such materials thus make it possible for the support 12 to limit the degradation of the layer 11 of phosphorescent material by restricting the temperature rise of the conversion device 3 and of the layer 11.

The layer 11 of phosphorescent material is suitable for re-emitting a white light radiation 16. In effect, when the first and second light radiation sources 1, 2 respectively emit a monochromatic and coherent laser radiation L1, L2 toward the conversion device 3, the latter receives this laser radiation L1, L2 and re-emits a white light radiation 16 which comprises a plurality of wavelengths belonging to the visible light spectrum and lying between approximately 400 nanometers and 800 nanometers.

This white light emission occurs according to a lambertian emission pattern, that is to say with a uniform luminance in all directions. The substrate of this conversion device 3 is made for example of metallic material, notably of aluminum. This metallic material forming the substrate exhibits good thermal conduction and resistance characteristics and properties. Thus, the substrate advantageously makes it possible to limit the temperature of the layer 11 of phosphorescent material, by promoting the heat dissipation.

Furthermore, this substrate can be exposed to laser powers without breaking down, which can for example be of the order of 15 watts. Thus, the conversion device 3 is therefore arranged in the light module so as to be able to receive laser radiations L1, L2 from the first light radiation source 1 and from the second light radiation source 2. It is therefore a conversion device 3 common to all the laser light sources.

This conversion device 3 is situated in the vicinity of the focal plane of the optical projection system 4 which then forms, at infinity, an image of the layer 11 of phosphorescent material, or more specifically of the points of this layer 11 which emit light in response to the laser excitation resulting from the laser radiations L1, L2 that they receive from the first and second light radiation sources 1, 2.

More specifically, the optical projection system 4 forms a light beam 15 with the light radiation 16 emitted by the different points of the layer 11 of phosphorescent material illuminated by these laser radiations L1, L2. The light beam 15 emerging from the light module is thus directly a function of the light rays emitted by the layer 11 of phosphorescent material, which is itself a function of the laser radiations L1, L2 absorbed by this layer 11.

It will be noted that the laser radiation L1 from the first light radiation source 1 forms an image to be projected by the optical projection system 4, by scanning, by exploiting the retinal persistence and/or the metastability of the phosphorescent material.

Furthermore, the first and second light radiation sources 1, 2, the conversion device 3 and the optical projection system 4 are included in this single light module with which a headlight is equipped.

Consequently, these first and second light radiation sources 1, 2 share the same conversion device 3 and optical projection system 4. Thus, the bulk of the light module, but also that of the headlight in which it is mounted, is greatly reduced.

In a first variant, the first light radiation source 1 is suitable for emitting a light radiation L1 onto a first zone of the conversion device 3, and the second light radiation source 2 is suitable for emitting a light radiation L2 onto a second zone of the conversion device 3, the first zone and the second zone overlapping only over a strip, notably central, of the conversion device.

The width of this strip is less than the width of the conversion device 3, notably less than 5% of the width of the conversion device 3. Optionally, the first zone and the second zone extend together over all of the conversion device 3.

In a second variant, the first and second light radiation sources 1, 2 are each suitable for emitting a light radiation L1, L2 onto a same zone of the conversion device 3, notably onto all of the surface of the conversion device 3.

This light module also comprises a control unit 5 which is suitable for driving the first and second light radiation sources 1, 2 as a function of the desired photometry of the light beam 15 produced by this light module.

In particular, the control unit 5 drives the scanning system 7 for the laser radiation L1 to successively scan all the points of the layer 11 of the phosphorescent material selected by this control unit 5. Thus, it is suitable for defining zones of the layer 11 that have to be scanned with the laser radiations L1 so as to form an image on this layer 11, such an image consisting of a succession of lines each formed by a succession of more or less luminous dots.

The control unit 5 also drives the activation and the control of the power of the first 1 and second 2 laser light sources and, if appropriate, the modulation of the intensity of the laser radiations L1, L2.

It will be noted that the points of the layer 11 of the phosphorescent material that are thus lit by the laser radiations L1, L2 emit light, with an intensity which is directly a function of the intensity of these laser radiations L1, L2 which light these points, the emission being performed according to a lambertian emission pattern.

According to the invention, this light module is suitable for emitting a light beam 15. This light beam 15 corresponds to the superpositioning of light beams resulting from the first and second light radiation sources 1, 2 cooperating with the wavelength conversion device 3 and the optical projection system 4.

This superpositioning can be partial or complete or even relate to only a fraction of the respective contours of these beams. This light beam 15 can result from the superpositioning of at least two different light beams.

In a second embodiment, not represented in the figures, the second light radiation source 2 comprises a second laser light source and a second scanning system in a single direction. In other words, according to this embodiment, the first and second light radiation sources are substantially the same, because the second scanning system is of the same type as that of the first scanning system. The scanning directions of the two scanning systems can notably be parallel or at right angles to one another.

In a third embodiment, not represented in the figures, the second light radiation source 2 comprises a second laser light source and a second scanning system in two directions. In other words, the second scanning system can perform a two-dimensional scan by using a micro-mirror for example. This micro-mirror is made mobile about two orthogonal axes from, for example, an MEMS (Micro-Electro-Mechanical System) device.

According to another execution variant, the scanning system can be formed by the association of two micro-mirrors, each being mobile about a single axis, the two axes being orthogonal. This scanning system reflects a laser radiation L2 from the second laser light source to the wavelength conversion device 3. This radiation L2 can then be deflected in two directions by the scanning system.

Figure 2:
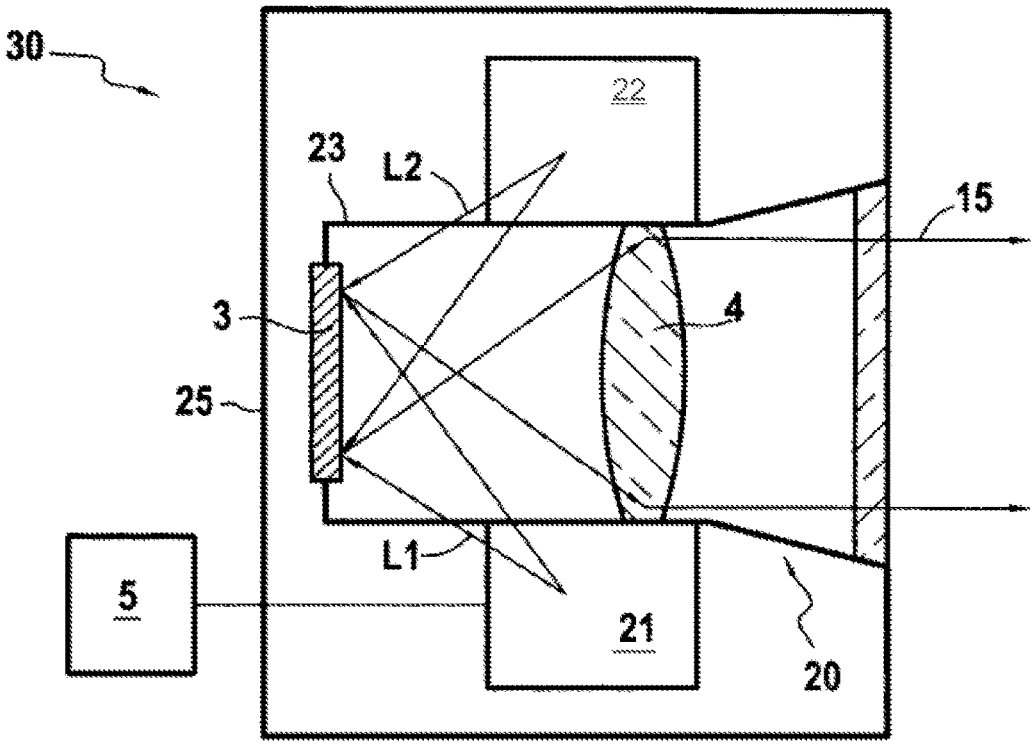
FIG. 2 is a schematic view of a headlight provided with a light module according to the invention.

FIG. 2 represents a headlight 30 with a module 20 according to the invention, housed in a casing 25. This module 20 comprises the units 21, 22 of the first and second radiation sources, which are arranged on either side of the conversion device 3. Each radiation source can thus emit a beam L1, L2 to the conversion device 3. The conversion device 3 then reflects these beams L1, L2 to the optical projection system 4 by modifying their color. The optical projection system 4 transmits them all outside the headlight 30 (beam 15). The module 20 here comprises a sub-casing 23 which holds the conversion device 3 on a wall of the bottom of the sub-casing 23, and two lateral walls which respectively bear the units 20, 21 on each side of the bottom wall. The sub-casing 23 also holds the optical projection system 4. Furthermore, a control unit 5 for the first and second light sources is linked to the module 20.

Figure 3:
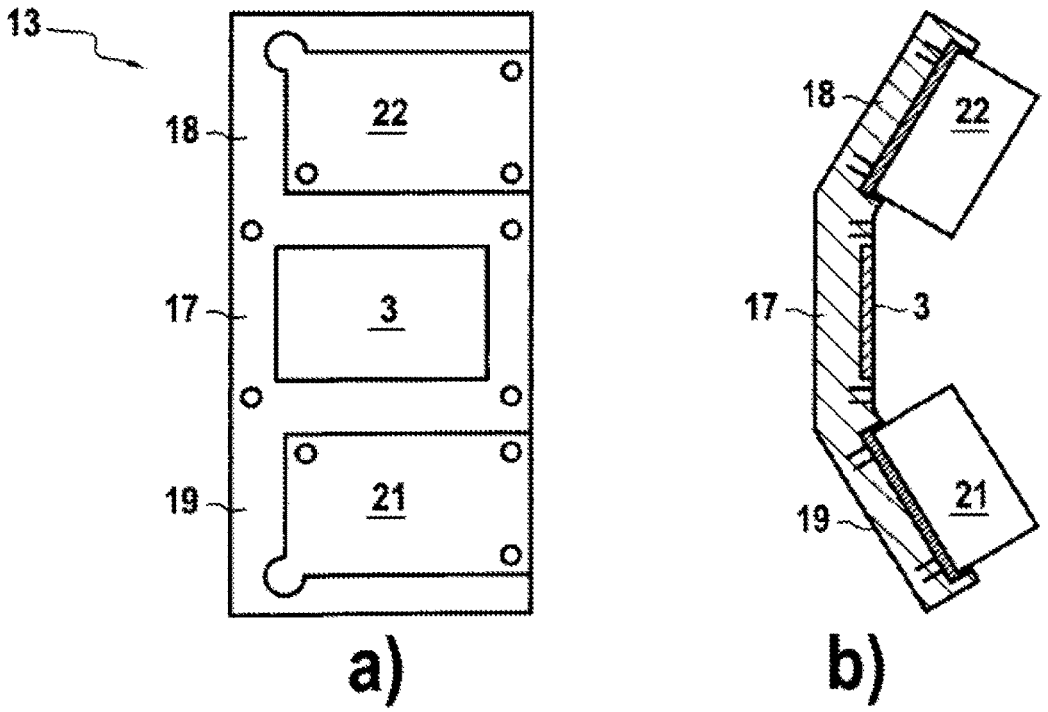
FIGS. 3 (*a*) and 3 (*b*) are schematic "front" and "profile" views of an exemplary support for a light module according to the invention.

FIGS. 3(*a*) and 3(*b*) represent an embodiment of a support 13 which is used to arrange the units 20, 21 of the module in a headlight. FIG. 3(*a*) shows the support 13 by "front view" and FIG. 3(*b*) by "profile view". The units 21, 22 of the first and second radiation sources 1, 2 are arranged on either side of the conversion device 3. To this end, the support 13 comprises three faces, a central face 17 provided with the conversion device 3, and two lateral faces 18 and 19 intended to each support one of the two units 21, 22. The lateral faces 18 and 19 exhibit, for example, a same angle with the central face 17. This angle is chosen so as to allow the first 1 and second 2 radiation sources to each emit their radiation to the conversion device 3. As shown in FIG. 3(*b*), this angle is, for example, approximately 120°.

This support 13 is standard such that it is possible to place thereon a unit comprising combinations of two radiation sources with a one- or two-dimensional scanning system, or even a static or quasi-static source, without the need to modify the other elements of the module. Thus, production and manufacturing savings are made. It is sufficient, for each combination desired in the module, to place the corresponding radiation sources on the support 13.

By virtue of this support 13, the headlight is itself standardized because the same elements are used, like the casing or the optical projection system 4, without having to adapt them to each combination of radiation sources of the module.

While the system, apparatus, process and method herein described constitute preferred embodiments of this invention, it is to be understood that the invention is not limited to this precise system, apparatus, process and method, and that changes may be made therein without departing from the scope of the invention which is defined in the appended claims.

What is claimed is:

1. A light module for a motor vehicle headlight comprising first and second light radiation sources suitable for emitting light radiations (L1, L2) to a wavelength conversion device which is likely to re-emit a light radiation to an optical projection system to produce a light beam wherein the light module comprises a single wavelength conversion device which is common to light radiations (L1, L2) of the first and second light radiation sources, and the first light radiation source comprises at least one first light source suitable for emitting a first light beam which cooperates with a first scanning, system, the first scanning system being movable along a single axis, wherein the first scanning system deflects light rays emitted by the first light radiation source and configured to scan the single wavelength conversion device with the first light beam in a unique first direction, and the second light radiation source comprises at least one second light source configured to emit a second light beam directly into a reflector.

2. The light module according to claim 1, wherein the second light radiation source is static or quasi static.

3. The light module according to claim 1, wherein the second light radiation source cooperates with a second scanning system in a single direction.

4. The light module according to claim 1, wherein the second light radiation source cooperates with a second scanning system in two directions.

5. The light module according to any claim 4, wherein the second scanning system is provided with one or two mobile micro-mirrors configured to scan the single wavelength conversion device with the second light beam in a first direction and/or a second direction substantially at right angles to the first direction.

6. The light module according to claim 1, wherein the first light radiation source is suitable for emitting the light radiation (L1) onto a first zone of the single wavelength conversion device, and the second light radiation source is suitable for emitting the light radiation (L2) onto a second zone of the single wavelength conversion device, the first zone and the second zone overlapping only over a strip of the single wavelength conversion device.

7. The light module according to claim 1, wherein the first and second light radiation sources are each suitable for emitting the light radiation (L1, L2) onto a same zone of the signal wavelength conversion device, notably onto all of a surface of the single wavelength conversion device.

8. The light module according to claim 1, wherein the first and second radiation sources are arranged on either side of the single wavelength conversion device.

9. The light module according to claim 8, wherein the light module comprises a support provided with a central wall bearing the single wavelength conversion device, and two lateral walls, one bearing the first light radiation source and the other bearing the second light radiation source.

10. The light module according to claim 1, wherein the single wavelength conversion device is arranged in an axis of the optical projection system.

11. A motor vehicle headlight comprising the light module according to claim 1.

12. The light module according to claim 2, wherein the first light radiation source is suitable for emitting the light radiation (L1) onto a first zone of the single wavelength conversion device, and the second light radiation source is suitable for emitting the light radiation (L2) onto a second zone of the single wavelength conversion device, the first zone and the second zone overlapping only over a strip of the single wavelength conversion device.

13. The light module according to claim 3, wherein the first light radiation source is suitable for emitting the light radiation (L1) onto a first zone of the single wavelength conversion device, and the second light radiation source is suitable for emitting the light radiation (L2) onto a second zone of the single wavelength conversion device, the first zone and the second zone overlapping, only over a strip of the single wavelength conversion device.

14. The light module according to claim 4, wherein the first light radiation source is suitable for emitting the light radiation (L1) onto a first zone of the single wavelength conversion device, and the second light radiation source is suitable for emitting the light radiation (L2) onto a second zone of the single wavelength conversion device, the first zone and the second zone overlapping only over a strip of the single wavelength conversion device.

15. The light module according to claim 2, wherein the first and second light radiation sources are each suitable for emitting the light radiation (L1, L2) onto a same zone of the single wavelength conversion device, notably onto all of a surface of the single wavelength conversion device.

16. The light module according to claim 3, wherein the first and second light radiation sources are each suitable for emitting the light radiation (L1, L2) onto a same zone of the single wavelength conversion device, notably onto all of a surface of the single wavelength conversion device.

17. The light module according to claim 4, wherein the first and second light radiation sources are each suitable for emitting a light radiation (L1, L2) onto a same zone of the single wavelength conversion device, notably onto all of a surface of the single wavelength conversion device.

18. The light module according to claim 5, wherein the first and second light radiation sources are each suitable for emitting a light radiation (L1, L2) onto a same zone of the single wavelength conversion device, notably onto all of a surface of the single wavelength conversion device.

19. The light module according to claim 2, wherein the first and second radiation sources are arranged on either side of the single wavelength conversion device.

20. The light module according to claim 2, wherein the single wavelength conversion device is arranged in an axis of the optical projection system.

* * * * *